US011309149B2

(12) United States Patent
Hashimoto et al.

(10) Patent No.: US 11,309,149 B2
(45) Date of Patent: Apr. 19, 2022

(54) ROCKER SWITCH

(71) Applicant: TOYO DENSO CO., LTD., Tokyo (JP)

(72) Inventors: Makoto Hashimoto, Tsurugashima (JP); Naoto Ohtsuka, Tsurugashima (JP)

(73) Assignee: Toyo Denso Co., Ltd., Tokyo (JP)

( * ) Notice: Subject to any disclaimer, the term of this patent is extended or adjusted under 35 U.S.C. 154(b) by 0 days.

(21) Appl. No.: 17/018,467

(22) Filed: Sep. 11, 2020

(65) Prior Publication Data

US 2021/0134542 A1 May 6, 2021

(30) Foreign Application Priority Data

Oct. 30, 2019 (JP) ..... JP2019-197186

(51) Int. Cl.
*H01H 23/30* (2006.01)
*H01H 23/14* (2006.01)

(52) U.S. Cl.
CPC ..... *H01H 23/143* (2013.01); *H01H 23/30* (2013.01)

(58) Field of Classification Search
CPC .... H01H 23/143; H01H 23/30; H01H 23/025; H01H 2300/03; H01H 23/145; H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26
See application file for complete search history.

(56) References Cited

U.S. PATENT DOCUMENTS 5,329,278 A * 7/1994 Dombroski ..... G06F 3/0234 200/343
5,853,326 A * 12/1998 Goto ..... H01H 9/0214 463/37
7,285,740 B2 10/2007 Nakajima

FOREIGN PATENT DOCUMENTS

JP S62-152329 A 7/1987
JP 2006-040614 A 2/2006

* cited by examiner

*Primary Examiner* — Ahmed M Saeed
(74) *Attorney, Agent, or Firm* — Carrier Blackman & Associates, P.C.; William D. Blackman; Joseph P. Carrier

(57) ABSTRACT

A rocker switch includes: a knob that rocks when an operational input is made; a case that supports the knob; a pair of switches that are provided on opposite end part sides respectively with respect to a middle part of the knob within the case; a rubber contact (an urging part) that urges opposite end parts of the knob toward a non-operated position; a pair of operation input parts that turn the respective switches ON/OFF; and a pair of fulcrum parts that are provided on the middle part side of the knob with respect to the pair of operation input parts respectively. In the pair of fulcrum parts, the fulcrum part on a side opposite to the operation input part, of the pair of operation input parts, that has turned the switch ON/OFF by an operational input being made serves as a rocking axis of the knob.

14 Claims, 7 Drawing Sheets

ROCKER SWITCH

BACKGROUND OF THE INVENTION

Field of the Invention

The present invention relates to a rocker switch in which a pair of switches are selectively turned ON/OFF by pushing opposite end parts of a knob in turn to thus rock the knob.

Description of the Related Art

A rocker switch is formed so as to include a knob that rocks with a fulcrum part as the center when its opposite end parts in a specific direction are selectively pushed, a case that supports the knob so that it can rock, a pair of switches that are provided at positions corresponding to the opposite end parts of the knob respectively within the case, and urging means that urges the opposite end parts of the knob in opposite pushing operation directions. In such a rocker switch, when one of the opposite end parts of the knob is pushed and the knob is rocked with the fulcrum part as the center, one of the pair of switches is turned ON. Therefore, when the opposite end parts of the knob are pushed in turn, the pair of switches are turned ON/OFF in turn.

When the knob rocks with the fulcrum part as the center due to one of the opposite end parts of the knob of the rocker switch being pushed as described above, since an end part on the opposite pushing operation side of the knob protrudes from a reference plane, there is the problem that the appearance of the rocker switch is degraded.

Japanese Patent Application Laid-open No. 2006-040614 proposes a rocker switch in which pins are provided on either one of a knob (button) and a case (support member) at positions corresponding to opposite end parts of the knob, elongated holes are provided at positions corresponding to the pins, and the knob is engaged with the case via the elongated holes. In accordance with such a rocker switch, when either one of the opposite end parts of the knob is pushed, the knob rocks with the pin on the opposite side (opposite pushing operation side) as the fulcrum, an end part, on the opposite pushing operation side, of the knob will not protrude greatly from a reference plane, and the appearance of the rocker switch will not be impaired.

Japanese Utility Model Application Laid-open No. S62-152329 proposes a rocker switch in which fulcrum parts are provided on portions protruding from opposite end parts of a knob (push button), these fulcrum parts are abutted against a reverse face of a panel member (escutcheon), and operating parts (pushing ribs) that act on a pair of switches are provided on inner sides of the two fulcrum parts respectively. In accordance with such a rocker switch, when one of the opposite end parts of the knob is pushed in order to make the knob rock, since the knob rocks toward the interior of the panel member with the fulcrum part provided on the other end part of the knob as a center, the other end part (the end part on the opposite pushing operation side) of the knob will not protrude greatly from the panel member, and the appearance of the rocker switch will not be impaired.

However, in the rocker switch proposed in Japanese Patent Application Laid-open No. 2006-040614, when the knob is made to rock, since the operating part of the knob pushes the switch (operation element) via a portion on the inner side of the fulcrum part (pin), if one of the opposite end parts of the knob is pushed and the knob is made to rock with the pin on the other end side (the opposite pushing operation side) as the fulcrum, the operating part of the other end part of the knob abuts against the switch via the portion on the inner side of the fulcrum part (pin), thus pushing the switch (operation element); therefore, due to said pushing the knob receives a reaction force from the switch (operation element) on the opposite pushing operation side, and there is the problem that because of the reaction force it will become difficult to set the operating load of the knob at a predetermined design value.

Furthermore, in the rocker switch proposed in Japanese Utility Model Application Laid-open No. S62-152329, since the fulcrum parts are provided on the outer side of the opposite end parts of the knob, it is necessary to ensure a predetermined clearance between the fulcrum parts and a peripheral member, and there is thus the problem that the rocker switch increases in size.

SUMMARY OF THE INVENTION

The present invention has been accomplished in light of the above problems, and it is an object thereof to provide a rocker switch that enables the operating load to be easily set at a design value without causing degradation of the appearance, increasing the size, or being influenced by excess reaction force.

In order to achieve the object, according to an aspect of the present invention, there is provided a rocker switch comprising a knob that rocks when an operational input is made, a case that supports the knob, a pair of switches that are provided on opposite end part sides respectively with respect to a middle part of the knob within the case, an urging part that urges opposite end parts of the knob toward a non-operated position, a pair of operation input parts that are provided at positions corresponding to the pair of switches respectively within the case and turn the respective switches ON/OFF, and a pair of fulcrum parts that are provided on the middle part side of the knob with respect to the pair of operation input parts respectively, wherein in the pair of fulcrum parts, the fulcrum part on a side opposite to the operation input part, of the pair of operation input parts, that has turned the switch ON/OFF by an operational input being made serves as a rocking axis of the knob.

In accordance with the aspect of the present invention, when one end part of the knob is for example pushed so as to input the operating force to one operation input part, the knob rocks with the fulcrum part on the opposite operation input side as the rocking axis, and the amount of displacement (amount of protrusion from a reference plane) of the knob on the opposite operation input side can thereby be kept small, thus preventing the appearance of the rocker switch from being degraded. Furthermore, since the operation input part and the fulcrum part do not protrude on the outer side of the opposite end parts of the knob, it is possible to prevent the rocker switch from increasing in size. Moreover, since the pair of operation input parts are disposed on the outer side of the pair of fulcrum parts, when the knob rocks with the fulcrum part on the opposite operation input side as the rocking axis, the end part on the opposite operation input side of the knob moves away from the switch side and will not receive a reaction force from the switch side. Because of this, it is possible to easily set the operating load of the knob at a design value without it being subject to the influence of excess reaction force.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained below by reference to the attached drawings.

[Arrangement of Rocker Switch]

Figure 1:
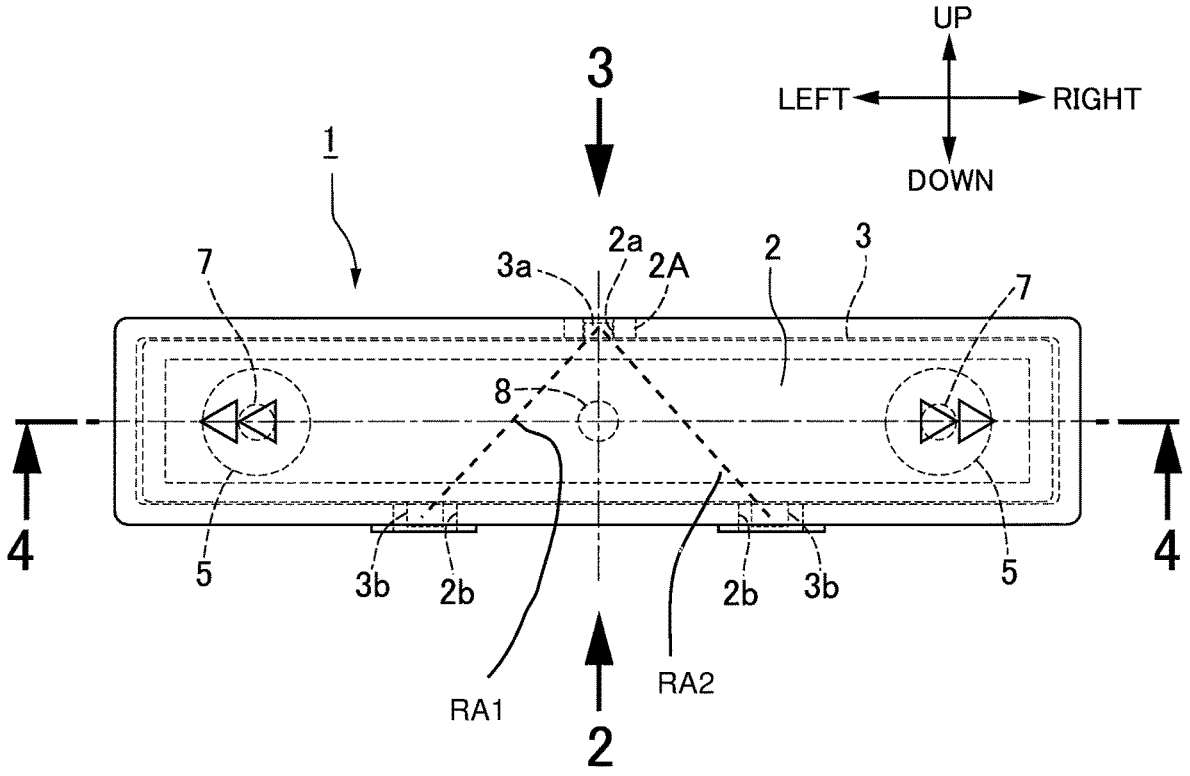
FIG. 1 is a front view of a rocker switch related to an embodiment of the present invention.
Figure 2:
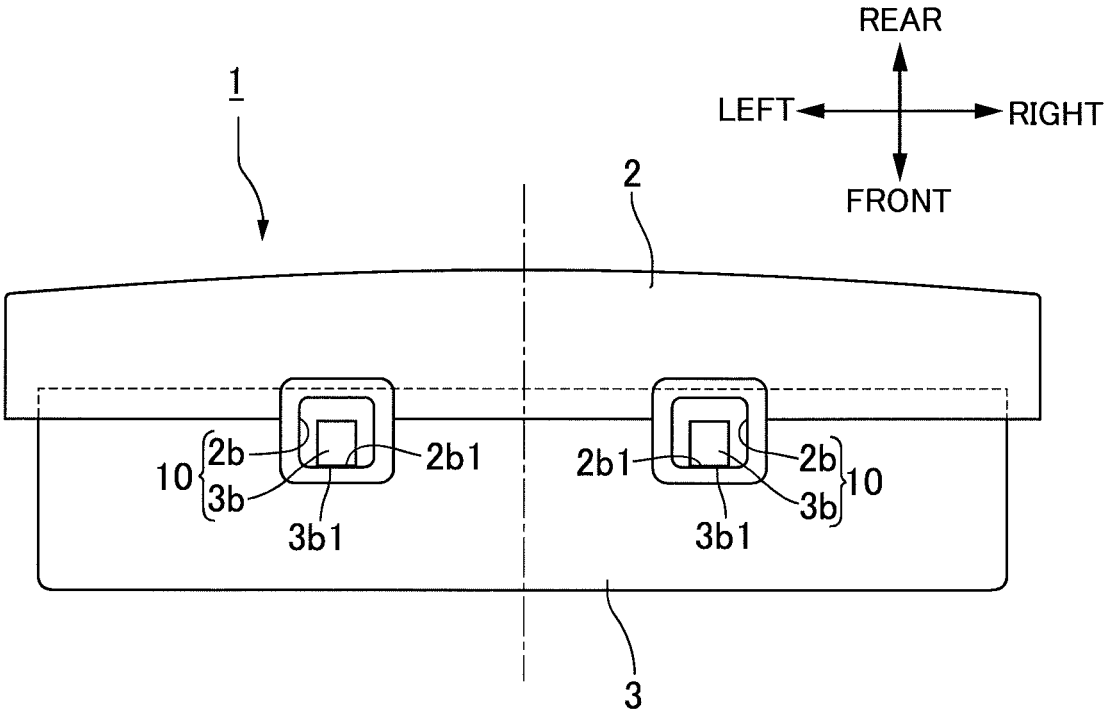
FIG. 2 is a bottom view of the rocker switch related to the embodiment of the present invention (a view from the direction of arrow 2 in FIG. 1).
Figure 3:
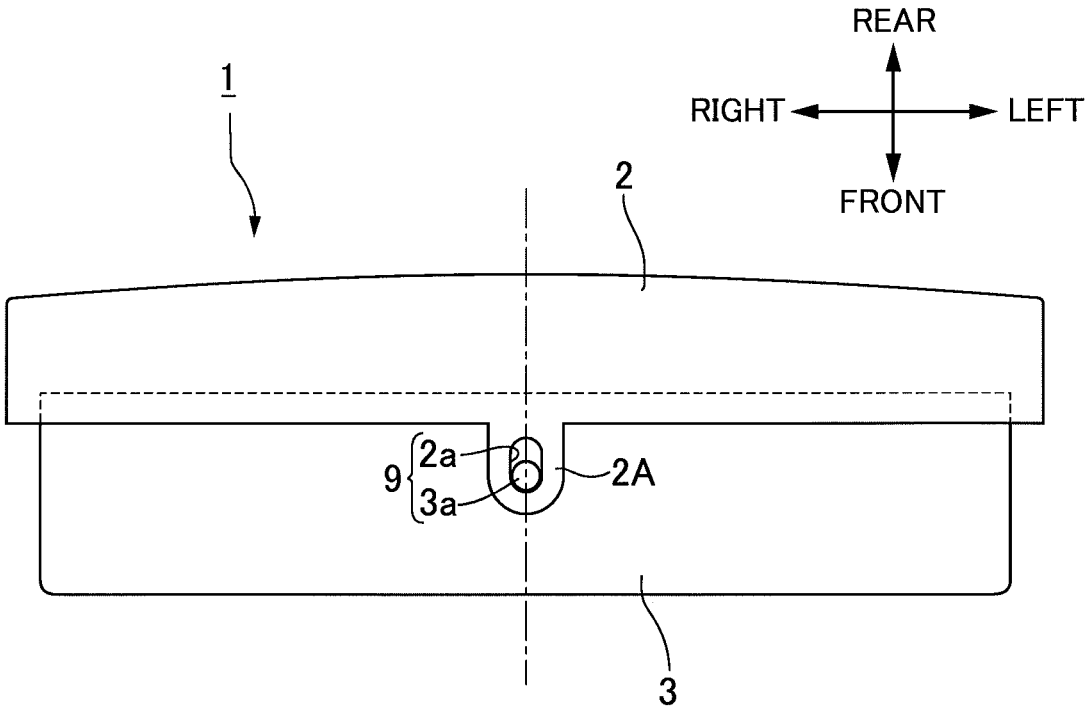
FIG. 3 is a plan view of the rocker switch related to the embodiment of the present invention (a view from the direction of arrow 3 in FIG. 1).
Figure 4:
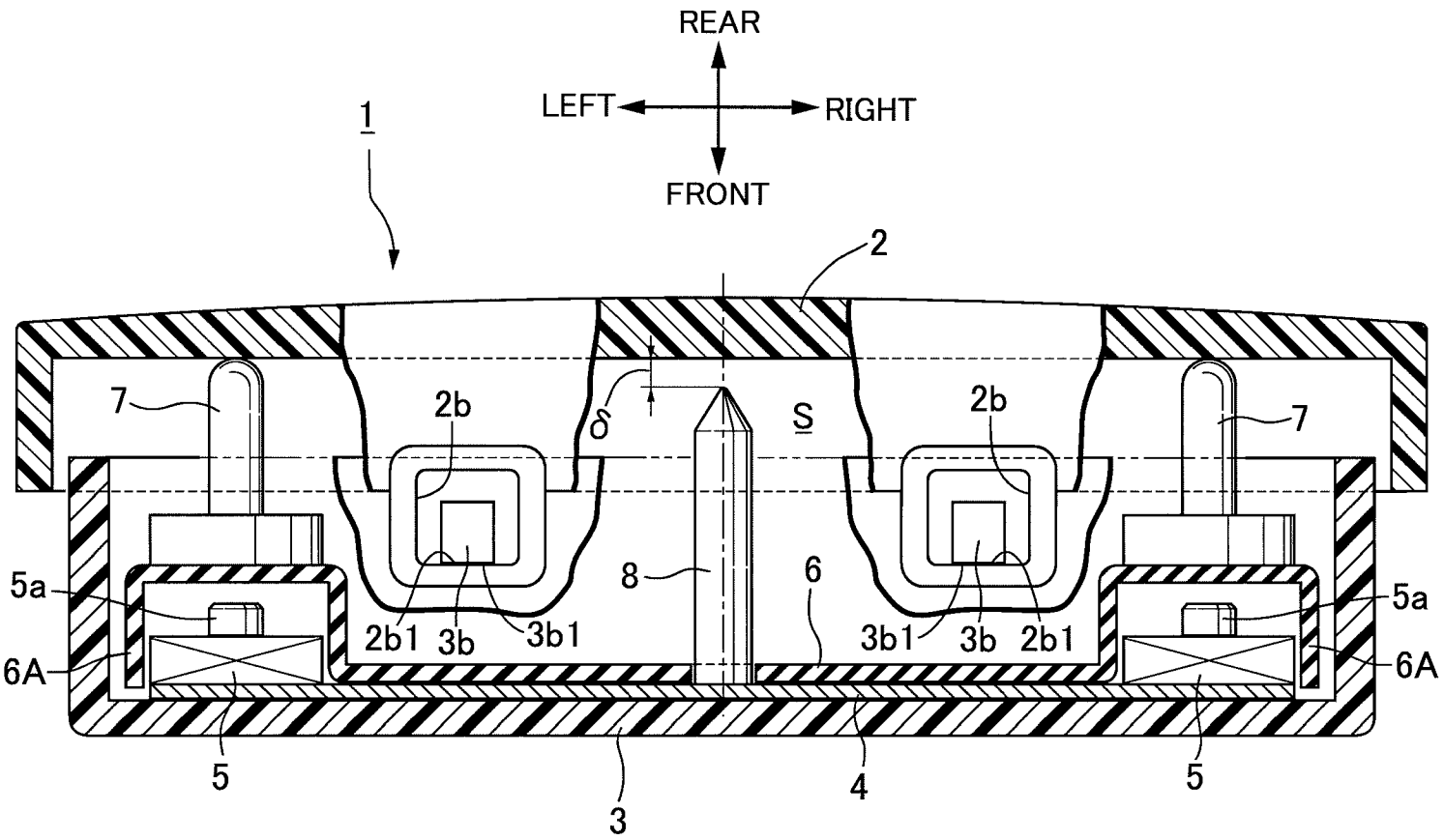
FIG. 4 is a sectional view along line 4-4 in FIG. 1.
Figure 5:
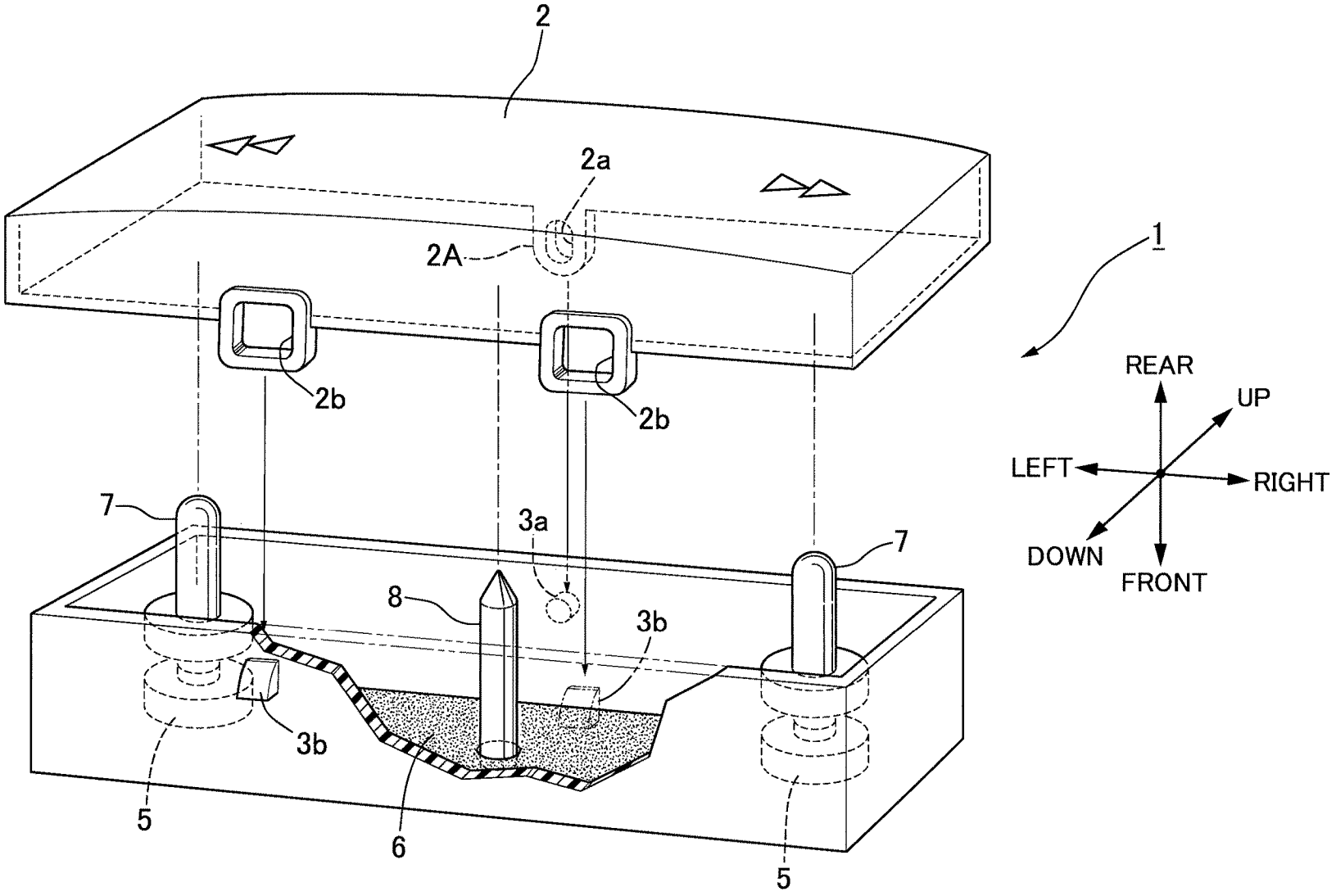
FIG. 5 is an exploded perspective view showing the rocker switch related to the embodiment of the present invention with part thereof cut away.

FIG. 1 is a front view of a rocker switch related to the embodiment of the present invention, FIG. 2 is a bottom view of the rocker switch (a view from the direction of arrow 2 in FIG. 1), FIG. 3 is a plan view of the rocker switch (a view from the direction of arrow 3 in FIG. 1), FIG. 4 is a sectional view along line 4-4 in FIG. 1, and FIG. 5 is an exploded perspective view showing the rocker switch with part thereof cut away. In the explanation below, as shown by arrows in FIG. 1 the lateral direction is 'left-and-right' and the longitudinal direction is 'up-and-down', and as shown by arrows in FIG. 2 the front side is 'rear' and the inner side is 'front'.

A rocker switch 1 as illustrated is provided on for example a spoke part of a steering wheel, which is not illustrated, of a vehicle, and a driver can operate the rocker switch 1 while gripping the steering wheel. This rocker switch 1 includes a rectangular box-shaped knob 2 that is long and narrow in the in the left-and-right direction (in a specific direction), and a rectangular box-shaped case 3 that is long and narrow in the in the left-and-right direction and supports the knob 2 so that it can rock. In the present embodiment, the knob 2 and the case 3 are molded from a resin such as ABS, the knob 2 being disposed on the front side (rear side), and the case 3 being disposed on the inner side of the knob (front side).

A plate-shaped bracket 2A is as shown in FIG. 3 horizontally and projectingly provided on the middle in the in the left-and-right direction of an upper face of the knob 2 so as to face forward (toward the case 3 side), and an elongated hole 2*a* that is long in the fore-and-aft direction is formed in an extremity part of the bracket 2A. A columnar engagement projection 3*a* is integrally and projectingly provided in the middle in the left-and-right direction of an upper face of the case 3 so as to face upward, and the engagement projection 3*a* is engaged with the elongated hole 2*a* of the bracket 2A projectingly provided on the upper face of the knob 2. The elongated hole 2*a* and the engagement projection 3*a* form an engagement part 9 between the knob 2 and the case 3.

Formed at two, left and right, locations close to a middle part in the left-and-right direction of a lower face of the knob 2 are rectangular window holes (engagement holes) 2*b* that are long in the rocking direction of the knob 2 as shown in FIG. 2, FIG. 4, and FIG. 5. Engagement claws 3*b* are integrally and projectingly provided at two, left and right, locations (locations corresponding to the two window holes 2*b* of the knob 2) of a lower face of the case 3, and these engagement claws 3*b* are engaged with the two window holes 2*b*, which are formed in the lower face of the knob 2. The knob 2 is therefore rockably assembled onto the case 3 and is selectively rockable around either one of two rocking axes RA1 and RA2 (FIG. 1), due to the engagement projection 3*a* projectingly provided on the upper face of the case 3 engaging with the elongated hole 2*a* of the bracket 2A projectingly provided on the upper face of the knob 2, and the two engagement claws 3*b* projectingly provided on the lower face of the case 3 engaging respectively with the two window holes 2*b* formed in the lower face of the knob 2. The two window holes 2*b* of the knob 2 and the two engagement claws 3*b* of the case 3, which are engaged with each other, form a fulcrum part 10 that works as a fulcrum when the knob 2 rocks as described later. Each time the rocking direction of the knob 2 changes, the two fulcrum parts 10 cooperate with the engagement part to define the operative rocking axis of the knob 2 in turn. In this way, in the present embodiment, the fulcrum part 10, which is an end point of the rocking axis of the knob 2, is formed from the window hole 2*b* and the engagement claw 3*b*, which are used for assembling the knob 2 onto the case 3.

Each of the left and right fulcrum parts 10 is as shown in FIG. 2 formed from the window hole 2*b* and the engagement claw 3*b*, which can engage with the window hole 2*b*, and when either one of the left and right end parts of the knob 2 is pushed, a first section 3*b*1, on the side opposite to the direction urged by a rubber contact 6, of the engagement claw 3*b* and a second section 2*b*1, opposing the first section 3*b*1, of the window hole 2*b* are abutted against each other, thus forming the rocking axis as the rocking center of the knob 2.

As described above, when the knob 2 is assembled onto the case 3, as shown in FIG. 4, a space S is formed between the knob 2 and the case 3, and a flat circuit substrate 4 is provided on the rear face, facing the space S, of the case 3. A switch (in the present embodiment a microswitch) 5 that is turned ON/OFF by a pushing operation is mounted on left and right end parts (two locations corresponding to the left and right end parts of the knob 2) of the circuit substrate 4.

As shown in FIG. 4, the rubber contact 6, which covers the circuit substrate 4 and the two switches 5, is provided within the space S formed by the knob 2 and the case 3, and a projecting part 6A protruding rearward (upward in FIG. 4) is formed integrally with opposite end parts, covering the left and right switches 5, of the rubber contact 6.

When the rocker switch 1 is in a non-operated state (the initial position) (when the knob 2 is not being pushed), as shown in FIG. 4 the projecting parts 6A, covering the two switches 5, of the rubber contact 6 are not in contact with the left and right switches 5, and a predetermined gap is formed therebetween. An operation element 7 is disposed between the left and right projecting parts 6A of the rubber contact 6 and the left and right end parts of the knob 2 respectively. The left and right operation elements 7 form an operation input part that transmits a pushing force to the left and right switches 5 and turns the respective switch 5 ON/OFF. Therefore, with regard to the rubber contact 6, the left and right projecting parts 6A form an urging part that urges the left and right end parts of the knob 2 in the opposite operation input direction (upward in FIG. 4) via the left and right operation elements 7. In the present embodiment, as an urging part that urges the opposite end parts of the knob 2 toward the non-operated position, the rubber contact 6, which is a separate body from the switch 5, is used, but as an urging part an elastic member such as a spring, which is not illustrated, placed in the interior of the switch 5 or an elastic member provided as a separate body from the switch 5 may be used.

As shown in FIG. 4, a rod-shaped stopper 8 forming an erroneous operation-preventing part for preventing erroneous operation of the rocker switch 1 is perpendicularly standingly provided on a center part in the left-and-right direction on the case 3 side (in the present embodiment the rubber contact 6) so as to face the knob 2. The stopper 8 restricts parallel movement of the knob 2 in the pushing direction when the opposite end parts of the knob 2 are simultaneously pushed or when a middle part in the left-and-right direction between the opposite end parts of the knob 2 is pushed. A clearance δ is formed between the stopper 8 and the knob 2, the clearance δ preventing parallel movement of the knob 2 toward the pushing direction (downward in FIG. 4) by a predetermined amount or greater while allowing the knob 2 to rock.

In the rocker switch 1 related to the present embodiment, as shown in FIG. 4, the operation elements 7 as operation input parts that turn the left and right switches 5 ON/OFF are provided at positions corresponding to the opposite end parts respectively in the left-and-right direction of the knob 2, and the fulcrum parts 10 are provided at two locations on the inner side in the left-and-right direction of the operation element 7, the fulcrum parts 10 becoming the rocking axis (fulcrum) in turn due to the knob 2 being pushed and rocking. The rocking axis of the fulcrum part 10 is formed as described above from the second section **2*b*1 of the window hole 2*b* formed at the two, left and right, locations of the lower face of the knob 2 and the first section 3*b*1 of the engagement claw 3*b* projectingly provided at the two, left and right, locations of the lower face of the case 3. In the present embodiment, the operation elements 7 as operation input parts are provided at positions corresponding to the left and right end parts respectively of the knob 2, and the left and right switches 5 are turned ON/OFF by transmitting the pushing force applied to either one of the opposite end parts of the knob 2 to the respective switches 5 via the operation element 7, but a pushing-in portion 5*a* of each switch 5 may be extended to immediately beneath the knob 2, and the pushing-in portion 5*a*** may form the operation input part.

In the state shown in FIG. 4 in which the rocker switch 1 is in non-operated state (the initial position), since the knob 2 is urged in a direction opposite to the pushing operation direction (upward in FIG. 4) via the left and right operation elements 7 by the left and right projecting parts 6A of the rubber contact 6 as the urging part, the left and right window holes **2*b* of the knob 2 and the left and right engagement claws 3*b* of the case 3, which form the fulcrum part, are in contact with each other. In this state, the left and right switches 5** are both in an OFF state.

[Operation of Rocker Switch]

The operation of the rocker switch 1 arranged as above is now explained by reference to FIG. 6A to FIG. 7B.

Figure 6A:
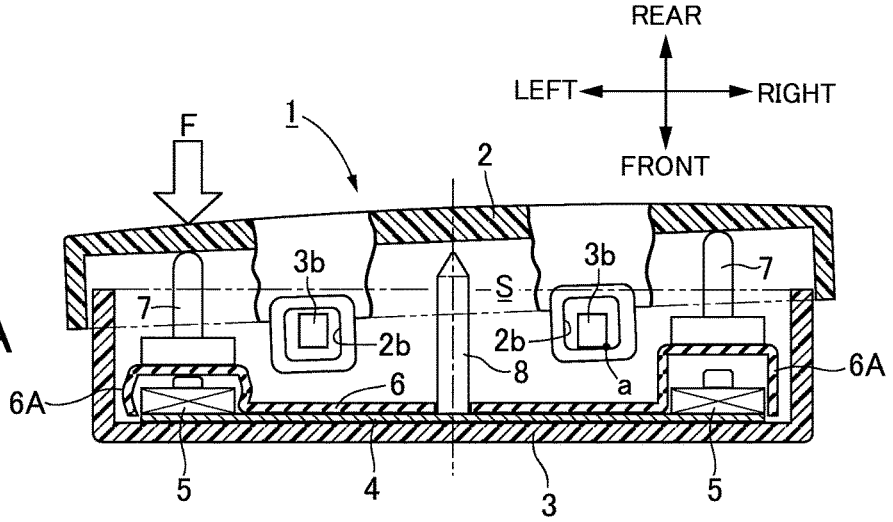
FIGS. 6A, 6B, 6C are sectional views for explaining the operation of the rocker switch related to the embodiment of the present invention, FIGS. 6A and 6B showing a state in which one end of a knob is being pushed, and FIG. 6C showing a state in which the center of the knob is being pushed.
Figure 6B:
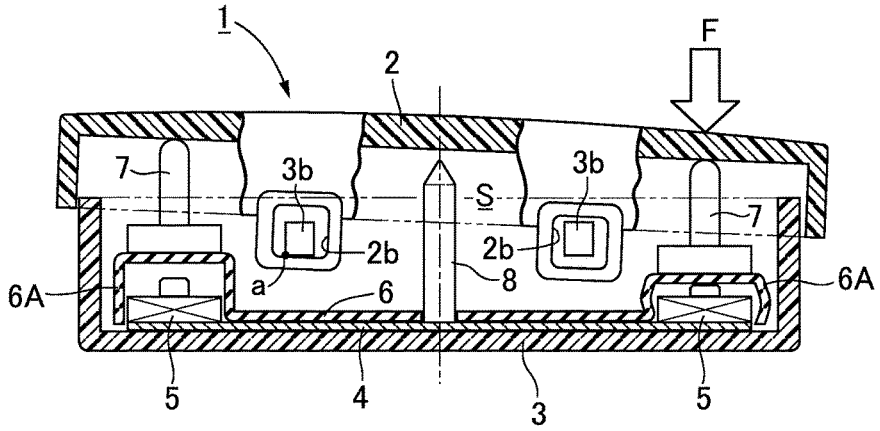
Figure 6C:
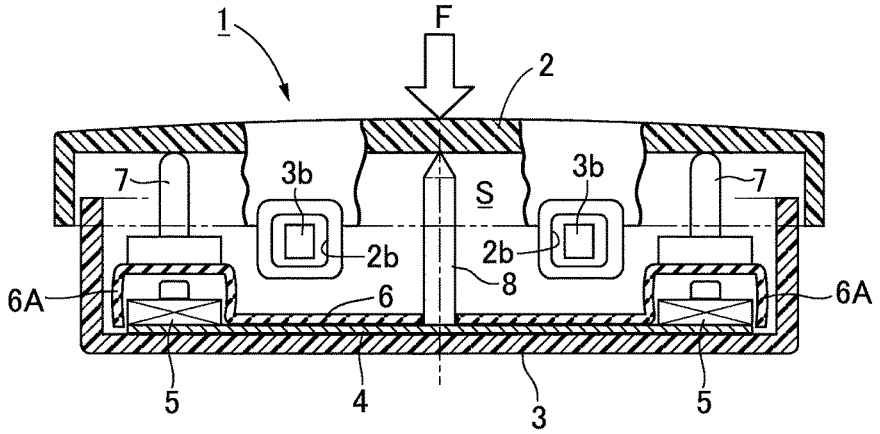
Figure 7A:
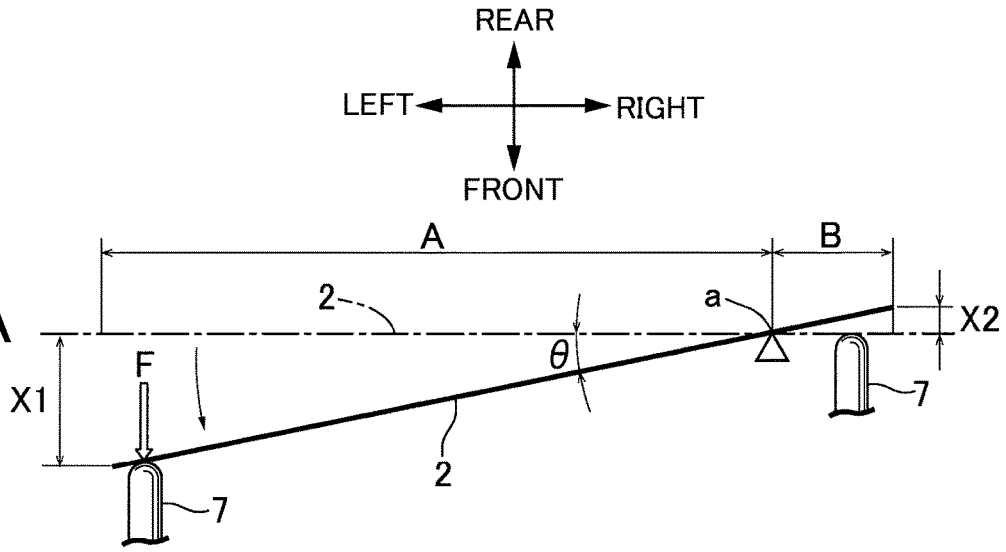
FIGS. 7A, 7B are views schematically showing the relationship between a fulcrum, a point of action, and a reaction force acting on the knob from a switch (operation element) when the knob of the rocker switch is pushed, FIG. 7A showing the rocker switch related to the embodiment of the present invention, and FIG. 7B showing a conventional rocker switch.
Figure 7B:
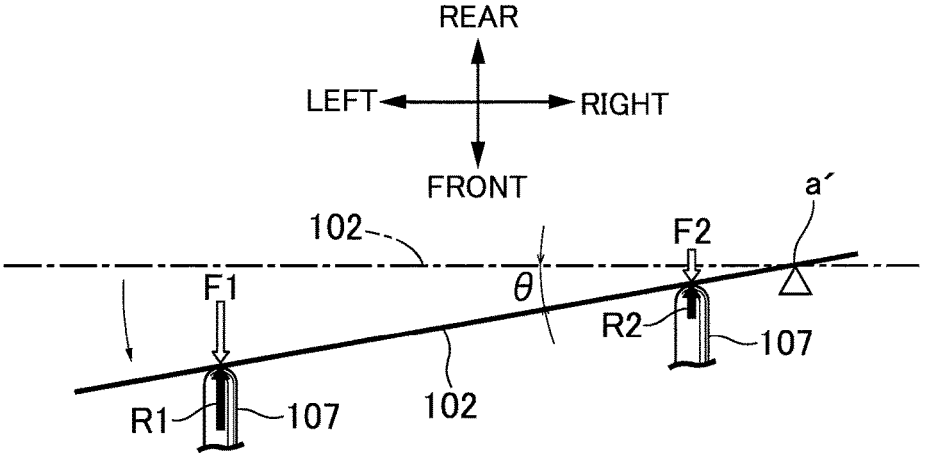

FIGS. 6A, 6B, and 6C are schematic views for explaining the operation of the rocker switch related to the embodiment of the present invention, FIGS. 6A and 6B showing a state in which one end of a knob is being pushed, and FIG. 6C showing a state in which the center of the knob is being pushed, and FIGS. 7A and 7B are views schematically showing the relationship between the fulcrum, the point of action, and the reaction force acting on the knob from the switch (operation element) when the knob of the rocker switch is pushed, FIG. 7A showing the rocker switch related to the embodiment of the present invention, and FIG. 7B showing a conventional rocker switch.

When the left end part of the knob 2 is pushed in the state shown in FIG. 4 in which the rocker switch 1 is in the non-operated state (the initial position), as shown in FIG. 6A the knob 2 rocks with as the fulcrum a point a of the fulcrum part 10 on the opposite pushing operation side (on the right side of FIG. 6A). Rocking of the knob 2 will not be inhibited by the stopper 8.

The switch 5 on the pushing operation side (on the left side) is pushed via the operation element 7 and the projecting part 6A of the rubber contact 6 and turned ON, and the switch 5 on the opposite pushing operation side (on the right side) maintains an OFF state.

Rocking of the knob 2 is schematically shown in FIG. 7A. Due to the left end part of the knob 2 being pushed, the knob 2 rocks from the chain-line position to the solid-line position with the fulcrum a as the center; when one switch 5 (on the left side) is turned ON, the left end part of the knob 2 is displaced only by x1 as shown, and the right end part (the end part on the opposite pushing operation side) is displaced only by x2 as shown. When the rocking angle of the knob 2 in this process is θ, the distance from the fulcrum a of the left end part of the knob 2 is A, and the distance from the fulcrum a of the right end part of the knob 2 is B, the displacement x1 of the left end part of the knob 2 and the displacement x2 of the right end part are given by the equations below.

$$x1=A\cdot\sin\theta \quad (1)$$

$$x2=B\cdot\sin\theta \quad (2)$$

Because of A>B, the magnitudes of the displacement x1 and the displacement x2 hold the following relationship.

$$x1>x2 \quad (3)$$

In this way, since the displacement x2 of the end part (right end part) on the opposite pushing operation side of the knob 2 is kept small, the amount of the end part (right end part) protruding can be kept small, thereby preventing the appearance of the rocker switch 1 from being degraded.

In the rocker switch 1 related to the present embodiment, since the operation elements 7 as the left and right operation input parts of the knob 2 are disposed on the outer side of the fulcrum part 10 (the point a) in the left-and-right direction, all of the pressing force F of the end part (left end part) on the pushing operation side of the knob 2 acts on the switch 5 via the operation element 7, whereas the end part (right end part) on the opposite pushing operation side of the knob 2 is displaced to a direction away from the operation element 7 and does not push the operation element 7. Because of this, the right end part of the knob 2 will not receive a reaction force from the operation element 7, and as described above all of the pressing force F acting on the left end part of the knob 2 acts on one switch 5 (on the left side). The operating load of the knob 2 can therefore easily be set to a design value without being influenced by excess reaction force.

On the other hand, in the conventional rocker switch, the relationship between the fulcrum, the point of action, and the reaction force acting on a knob from a switch (operation element) is as schematically shown in FIG. 7B.

That is, a left end part of a knob 102 is for example pushed, a pressing force F1 acts on an operation element 107 on the left side of the knob 102 to thus push down the operation element 107, and in this process the knob 102 receives a reaction force R1 as shown from the operation element 107. In the conventional rocker switch, since the operation element 107 is disposed on the inner side of a fulcrum a', if the knob 102 rocks only by an angle θ as shown from the chain-line position to the solid-line position with the fulcrum a' on the right side as the center in the figure, the right end part of the knob 102 of FIG. 7B abuts against the operation element 107 and pushes the operation element 107 with a pressing force F2, and the knob 102 will receive a reaction force R2 as shown from the operation element 107 on the right side. In this way, since in the conventional rocker switch the knob 102 receives the reaction forces R1, R2 from the left and right operation elements 107 respectively, it becomes difficult to set the operating load of the knob 102 at a design value, and a large amount of work is required for setting the operating load.

In the rocker switch 1 related to the present embodiment, since all components such as the fulcrum part 10 (the window hole 2*b* of the knob 2 and the engagement claw 3*b* of the case 3), the operation element 7, and the switch 5 are disposed within the range of the length in the left-and-right direction of the knob 2, any increase in the dimensions of the rocker switch 1 can be prevented.

A state in which the right end part of the knob 2 is pushed is shown in FIG. 6B, and in this process the knob 2 rocks with the fulcrum a on the opposite pushing operation side (the left side) as a center and pushes the switch 5 on the right side via the operation element 7 and the projecting part 6A of the rubber contact 6, thus turning the switch 5 ON. In this process, the switch 5 on the opposite side (the left side) maintains an OFF state. The stopper 8 will not inhibit rocking of the knob 2.

Also, when the right end part of the knob 2 is pushed, the knob 2 pivots with the fulcrum a on the opposite pushing operation side (on the left side in FIG. 6B) as a center, and in this process since the amount of displacement of the end part (left end part) on the opposite pushing operation side of the knob 2 is kept small, the appearance of the rocker switch 1 will not be impaired. For the same reason as given above, the left end part of the knob 2 will not receive a reaction force from the operation element 7, and all of the pressing force F acting on the right end part of the knob 2 acts on the switch 5 on the right side. It is therefore possible to easily set the operating load of the knob 2 to a design value without being influenced by excess reaction force.

FIG. 6C shows a state in which the middle part in the left-and-right direction of the knob 2 is pushed. In this case, the knob 2 is moved forward in parallel (downward in FIG. 6C) by the pressing force F acting on the middle part. The amount of parallel movement of the knob 2 is restricted to a predetermined amount (the clearance δ between the knob 2 and the stopper 8) due to the knob 2 abutting against the extremity of the stopper 8. The clearance δ between the knob 2 and the stopper 8 is set to be a value that prevents the left and right switches 5 from being turned ON. Because of this, the malfunction of the left and right switches 5 being turned ON simultaneously when the middle part in the left-and-right direction of the knob 2 is pushed can be reliably prevented from occurring.

Although not illustrated, even when the left and right end parts of the knob 2 are simultaneously pushed, since parallel movement of the knob 2 by a predetermined amount (the clearance δ between the knob 2 and the stopper 8) or greater can be prevented by the stopper 8, it is possible to reliably prevent the occurrence of the malfunction of the left and right switches 5 being turned ON simultaneously.

As is clear from the above explanation, in accordance with the embodiment of the present invention, the effect of the operating load of the knob 2 being able to be easily set to a design value can be obtained without causing degradation of the appearance of the rocker switch 1 or an increase in size and without being influenced by excess reaction force.

In the embodiment above, the window hole 2*b* forming the fulcrum part 10 is formed in the knob 2, and the engagement claw 3*b* is projectingly provided on the case 3, but alternatively an elongated hole may be formed in the case 3 and an engagement claw may be projectingly provided on the knob 2.

Furthermore, in the embodiment above, the stopper 8 is provided on the case 3 side, but the stopper 8 may be provided on the knob 2 side.

In the illustrated embodiment, the mode of operation of the knob 2 is a pushing operation, but an operation mode may be employed in which a lever-shaped member is projectingly provided on the knob 2, and the lever-shaped member may be tilted so as to make the knob 2 rock.

An embodiment of the present invention is explained above, but the present invention is not limited to the above-mentioned embodiment and may be modified in a variety of ways as long as the modifications do not depart from the gist of the present invention.

The present invention is not limited to a rocker switch disposed on a spoke part of a steering wheel of a vehicle, and may be applied to any type of rocker switch.

What is claimed is:

1. A rocker switch comprising a knob that is configured to rock when an operational input is made, a case that supports the knob, two switches that are provided within the case on opposite end part sides respectively with respect to a middle part of the knob, an urging part that urges opposite end parts of the knob toward a non-operated position, a pair of operation input parts that are provided at positions corresponding to the pair of switches respectively within the case and are configured to turn the respective switches ON/OFF, a pair of fulcrum parts that are provided at spaced apart positions on one of opposite lateral sides of the knob near the middle part of the knob with respect to the pair of operation input parts respectively, and one engagement part that is provided at a position on another of the opposite lateral sides of the knobs substantially at the middle part of the knob and centered between the fulcrum parts, for providing engagement between the knob and the case, wherein the knob is rockably assembled onto the case by the pair of fulcrum parts and the engagement part, and wherein during operation, one of the pair of fulcrum parts, which is positioned on a side opposite to one of the pair of operation input parts that has turned the switch ON/OFF by an operational input being made, serves as a rocking axis of the knob.

2. The rocker switch according to claim 1, wherein each of the fulcrum parts has a window hole and an engagement claw that can engage with the window hole, and wherein the rocker switch is configured such that when an operational input is made, a first section of the engagement claw and a second section of the window hole are abutted against each other to form the rocking axis, the first section being on a side opposite to a direction urged by the urging part, and the second section opposing the first section.

3. The rocker switch according to claim 2, wherein the window hole is formed so as to be long in a rocking direction of the knob.

4. The rocker switch according to claim 3, wherein the window hole is formed in one of the knob and the case, and the engagement claw is formed in the other of the knob and the case.

5. The rocker switch according to claim 1, wherein an erroneous operation-preventing part is provided on at least either one of the knob and the case, the erroneous operation-preventing part restricting concurrent parallel movement of both ends of the knob in an operation direction when the opposite end parts of the knob are simultaneously operated or when the middle part of the knob is operated.

6. The rocker switch according to claim 2, wherein an erroneous operation-preventing part is provided on at least either one of the knob and the case, the erroneous operation-preventing part restricting concurrent parallel movement of both ends of the knob in an operation direction when the opposite end parts of the knob are simultaneously operated or when the middle part of the knob is operated.

7. The rocker switch according to claim 3, wherein an erroneous operation-preventing part is provided on at least either one of the knob and the case, the erroneous operation-preventing part restricting concurrent parallel movement of both ends of the knob in an operation direction when the opposite end parts of the knob are simultaneously operated or when the middle part of the knob is operated.

8. The rocker switch according to claim 4, wherein an erroneous operation-preventing part is provided on at least either one of the knob and the case, the erroneous operation-preventing part restricting concurrent parallel movement of both ends of the knob in an operation direction when the opposite end parts of the knob are simultaneously operated or when the middle part of the knob is operated.

9. The rocker switch according to claim 5, wherein the erroneous operation-preventing part has a stopper projectingly provided on at least either one of the knob and the case, and a clearance is formed between the stopper and the knob or case, the clearance allowing the knob to rock and preventing concurrent parallel movement of both ends of the knob toward the operation direction by a predetermined amount or greater.

10. The rocker switch according to claim 6, wherein the erroneous operation-preventing part has a stopper projectingly provided on at least either one of the knob and the case, and a clearance is formed between the stopper and the knob or case, the clearance allowing the knob to rock and preventing concurrent parallel movement of both ends of the knob toward the operation direction by a predetermined amount or greater.

11. The rocker switch according to claim 7, wherein the erroneous operation-preventing part has a stopper projectingly provided on at least one of the knob and the case, and a clearance is formed between the stopper and the knob or case, the clearance allowing the knob to rock, and preventing concurrent parallel movement of both ends of the knob toward the operation direction by a predetermined amount or greater.

12. The rocker switch according to claim 8, wherein:

the erroneous operation-preventing part has a stopper projectingly provided on at least either one of the knob and the case, and a clearance is formed between the stopper and the knob or case, the clearance allowing the knob to rock and preventing concurrent parallel movement of both ends of the knob toward the operation direction by a predetermined amount or greater.

13. The rocker switch according to claim 1, wherein the engagement part comprises an elongated hole provided on one of the knob and the case, and an engagement projection provided on the other of the knob and the case and engaged with the elongated hole.

14. The rocker switch according to claim 1, wherein:

a first portion of each fulcrum part is formed on the case, a second portion of each fulcrum part is formed on the knob, a first portion of the engagement part is formed on the case, and a second portion of the engagement part is formed on the knob.

* * * * *